United States Patent [19]

Breese

[11] 4,095,797

[45] Jun. 20, 1978

[54] GOLF CLUB SWING TRAINING DEVICE

[76] Inventor: Nicholas V. Breese, 4413 Melvin Rd., Lakeworth, Fla. 33461

[21] Appl. No.: 680,132

[22] Filed: Apr. 26, 1976

[51] Int. Cl.[2] ..... A63B 69/36

[52] U.S. Cl. ..... 273/186 C; 273/187 R

[58] Field of Search ..... 273/187 R, 187 A, 183 A, 273/186 C, 186 R, 176 L; 35/29 A; 33/91, 98, 99, 116, 118, 105

[56] References Cited

U.S. PATENT DOCUMENTS

| | | | |
|---|---|---|---|
| 431,484 | 7/1890 | Roe | 33/98 |
| 1,470,117 | 10/1923 | MacRae | 273/176 L |
| 3,141,675 | 7/1964 | Street | 273/187 R |
| 3,860,247 | 1/1975 | Taylor | 273/187 A X |
| 3,887,193 | 6/1975 | Stanley | 273/187 R X |

FOREIGN PATENT DOCUMENTS

| | | | |
|---|---|---|---|
| 17,666 | 10/1916 | United Kingdom | 273/187 R |

*Primary Examiner*—George J. Marlo
*Attorney, Agent, or Firm*—Duane C. Bowen

[57] ABSTRACT

An impact zone, the proper movement of the club head in the impact zone in the direction of the desired path of the ball, and the proper orientation of the club head face at right angles to that direction are indicated by a body having two arms and a leg in T-configuration. The arms are releasably secured at right angles to said leg, to permit collapsing same against the leg for carrying. Abutting edges on the arms assist proper alignment of the arms and there is indicia on the face of the body directing use of the instrument in improving a golfer's swing.

1 Claim, 6 Drawing Figures

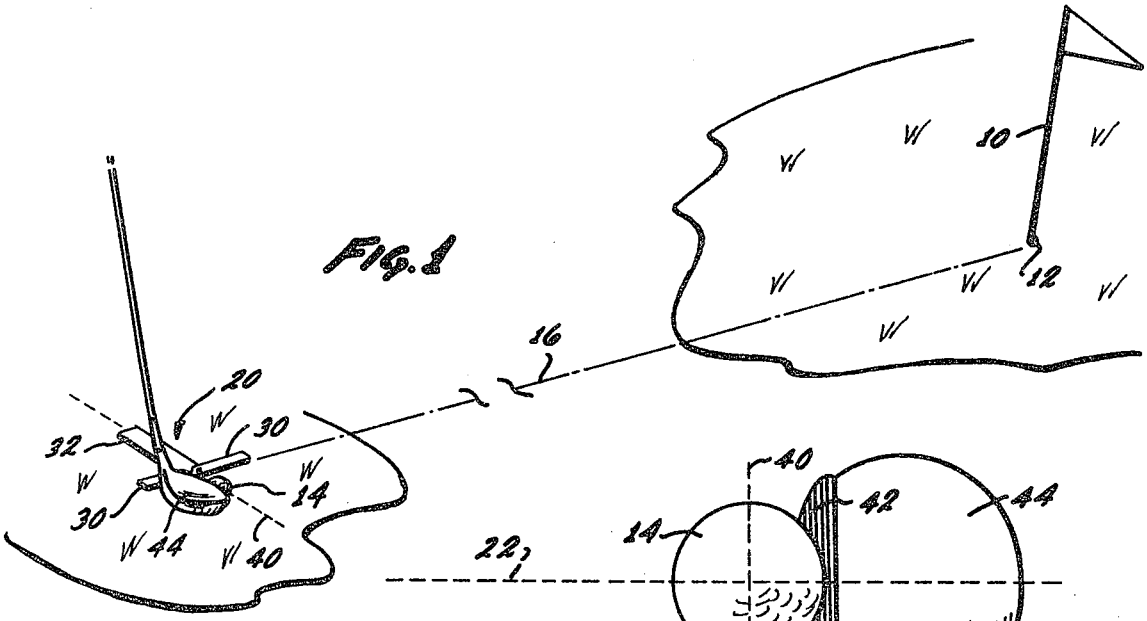
Fig. 1
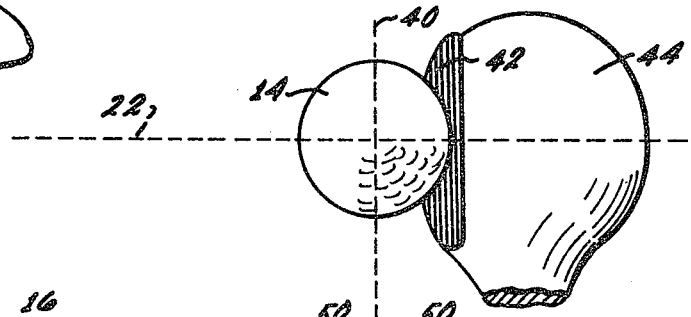
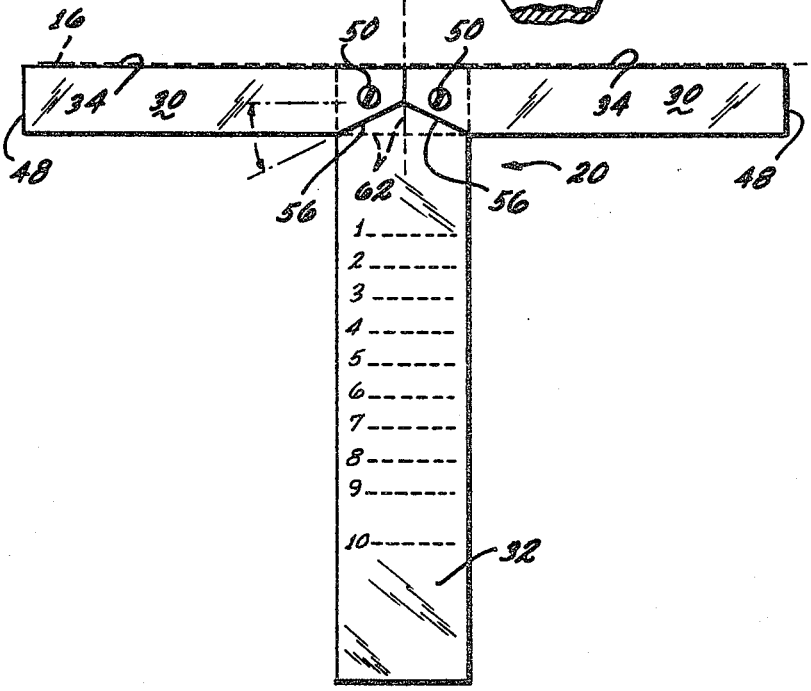
Fig. 2
Fig. 3
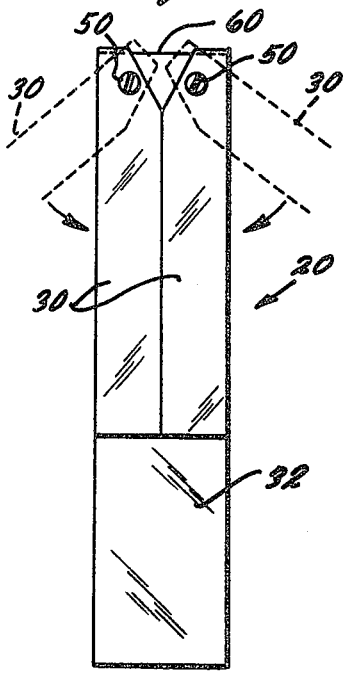
Fig. 4
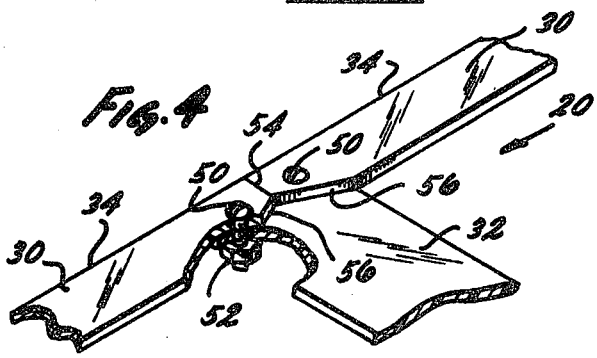

GOLF CLUB SWING TRAINING DEVICE

BRIEF SUMMARY OF THE INVENTION

My invention relates to a method and means for improving a golfer's swing by maintaining proper club head direction and orientation in the impact zone.

My concern is with improving the swing of a golfer and, thereby, to improve his ability to hit the golf ball straight consistently. This can be a problem with perhaps as many as 90% of the golfers. My observation was that in spite of millions of words of instructions printed annually, the overwhelming majority of golfers hit the ball poorly. They appear to be confused by the overabundance of conflicting swing theories available and have great difficulty in applying those theories. Golf professionals teach different swing systems, i.e., the "Classic Swing," the "Modern Swing," etc. As happened with myself, lessons from four professional golfers can result in four different sets of instructions.

A further confusing element is that practically all instruction relates to secondary aspects of the swing, i.e., hip rotation, wrist locking, weightshift, observation of the plane of the swing, etc. Little emphasis is given to what the swing is trying to accomplish, which is to orient and move the golf club head properly at the time of ball impact.

It became apparent to me that most people play golf poorly because they don't understand specifically what they are trying to accomplish with their swings. Such failure in comprehension would explain why so many fine athletes, who excel in other sports, fail to gain real proficiency in golf. The importance of the most basic elements of the swing may explain why golf professionals with quite different swings can still be successful, i.e., the differences in the swings of Jack Nicklaus and Lee Trevino who still are able to hit the ball straight consistently.

I decided there was a great need for a visual aid to instruct the golfer in what he was trying to accomplish with his swing. It would have to deal with basic principles and otherwise be flexible enough to accommodate much different swings, i.e., again those exemplified by Mr. Nicklaus and Mr. Trevino.

In investigating swing theories, it became obvious that there are basic laws of physics governing the action of the club head in striking the ball and the resultant flight of the ball. I realized that a device which visually corresponded with those laws of physics would provide the golfer with the instructional aid needed in order to develop dependable golf swing. By necessity, such a device would be compatible with all instructional methods as all of them have to be consistent with the laws of physics.

The most basic elements of a swing are (a) to bring the golf club head through the impact zone in the right direction, and (b) to maintain the club face at right angles to that direction.

I conceived of a readily portable device that would visually indicated to the golfer the impact zone, the proper direction of travel of the club head, and the correct orientation of the club face. I proceeded to construct prototypes that in practice and in experiments enabled golfers to hit balls much straighter, more consistently, thereby dramatically improving their golf scores.

The objects of my invention include: to devise a means and method for improving a golfer's swing of the type indicated above; to provide a golfer's aid which will define a suitable impact zone, which will provide a visible line indicating the direction of desired flight of the ball and the corresponding needed direction of movement of the club head in the impact zone, and which will indicate the proper orientation of the club head face in the impact zone; to devise such an instrument with collapsible arms with means to assist in orienting the arms 90° to a leg in T-orientation; to provide such an article with printed indicia on its face to instruct the golfer in proper use; and to devise such a means and method that will be acceptable to the golfer in practice usage and will improve his abilities and confidence to the end that he will be encouraged to continue and to improve in golfing.

My invention will be best understood, together with additional advantages and objectives thereof, from the following description, read with reference to the drawings, in which:

FIG. 1 is a perspective view of a specific embodiment of my invention and also illustrates its use on a golf course.

FIG. 2 is a plan view of the golfing aid, on enlarged scale, and also shows a golf ball and the head of a golf club.

FIG. 3 shows the golfing aid with its arms viewed in folded position in full lines. The dashed lines illustrate folding and unfolding of the arms.

FIG. 4 is a partial perspective view, with portions broken away to reveal structure that otherwise would be hidden.

Figure 5:
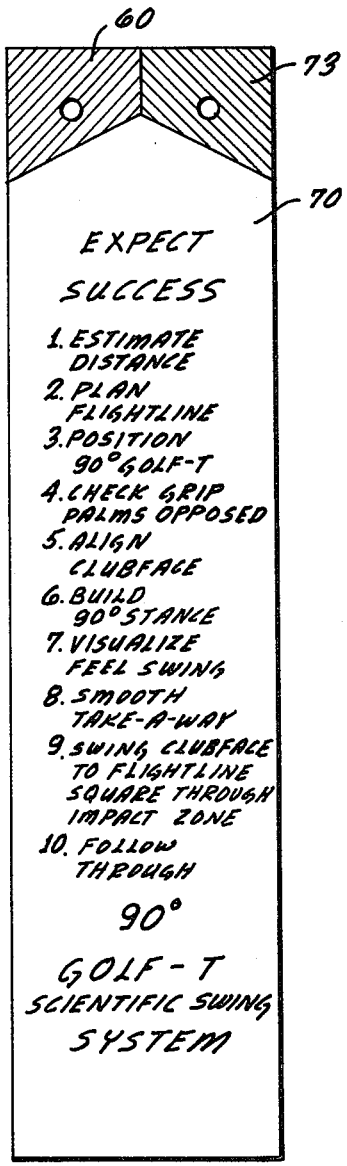
FIG. 5 is a plan view of a portion of the device on enlarged scale and showing the indicia displayed on the face thereof.

FIG. 1 shows a staff and flag 10 marking a hole 12. The golf ball is shown at 14. If the golfer were to be aiming directly for the pin in his shot, the desired direction of movement of the ball would be in a vertical plane including a line 16 from ball 14 to hole 12. My golfing aid is shown at 20. As illustrated, line 16 is in line from the edge of aid 20 closest to the ball to hole 12. As ball 14 is usually positioned two to four inches from aid 20, the desired line of light of ball 14 is more accurately that marked as 22 in FIG. 2. To get complete accuracy, (a) line 22 would have to converge toward line 16 and intersect at hole 12, or (b) line 16 would have to be directed at a point spaced from hole 12 the same distance as the spacing of ball 14 from device 20, in which case lines 16, 22 (or the vertical planes they represent) would be parallel. In most circumstances line 22 can be ignored and line 16 can be treated as the desired path of the ball to the point desired, i.e., hole 12. This is because, for example, if the distance were even no more than 100 feet (a relatively short distance) and the distance from the center of ball 14 to line 16 were about 3 inches, the angle between lines 16 and 22 if they converged at hole 12 would be roughly 10 minutes of 1°, which would be a difference outside of the capability of unaided eyesight. In a putting situation, however, with, for example, 6 feet to the pin and the center of ball 3 inches from line 16, the lines would converged at an angle of about $2\frac{1}{2}$, which would be significant, and, hence, line 16 should be aimed to the side of hole 12 a distance corresponding to the spacing of lines 22 and 16.

Although FIG. 1 illustrates a flight objective directly to the hole 12, more often the objective will be to some other location short of the green, in which case line 16 will be toward that other location. In other words, the user would follow normal procedures in playing a hole and successive lines 16 would represent his normal objectives of ball flights. When the phrase "desired direction of ball travel" is used in the claims, this should be interpreted that normally the user will align the appropriate edge of the golfing aid 20 directly at the objective of the particular golf stroke (line 16) as this is less confusing than to use the totally imaginary line 22; but when the golfer gets close, i.e., putting distance, then he sould align the golfing aid 20 (and line 16) to aim at a spacing from the objective (the hole) corresponding to the distance from the center of ball 14 to line 16.

Golfing aid 20 is generally of T configuration with two arms 30 at right angles to a generally centrally disposed leg 32. Arms 30 and leg 32 preferably are formed from a plastic sheet or from plastic strips. Suitable dimensions include a 7¼ inch length for leg 32, a 1¾ inch width, each arm 5 inches long and ⅞ inch wide. Preferred coloring choices for good visual characteristics are black arms 30, a white leg 32, and black printing on leg 32.

The edges of arms 30 opposite to leg 32 and adjacent to ball 14 should each be straight and together should form a straight line 34 in the unfolded position of arms 30 shown in FIGS. 1, 2 and 4. It is this straight line 34 of aid 20 that should be aligned with the desired direction of ball travel 16 (or to determined a parallel to line 22 in putting). A golfer could choose to align arms 30 in general relative to line 16 but if line 34 is used the direction can be more precise and that will be the instructions that are expected to accompany aid 20. Some such instructions would appear to be needed by the golfer unless someone like a club professional golfer sells the device and/or instructs use. To anticipate what will be said in more detail later, if the club head strikes ball 14 squarely and follows line 16 in the impact zone represented by the length of arms 30, then ball 14 should tend to follow line 16 in the desired direction of ball travel, so line 34 relates to a very fundamental matter in a golf stroke.

Either edge of leg 32, its imaginary centerline, or leg 32 in general can be considered to establish a second line 40 at 90° to the first line 34. If the face 42 of club head 44 is maintained parallel to line 40 (either edge of leg 32, or leg 32 in general as a broad line) as it passes through the impact zone and strikes ball 14, then ball 14 will tend to go at 90° to club face 42, or parallel to line 34 if club head 44 is following line 34. In putting, if golf club head 44 is moved parallel to line 34 in the impact zone, ball 14 will tend to go in the direction of line 16, which is a definition of a basic objective in a golfing stroke.

As before indicated, it is my observation that most golfers get caught up in other instructions about an ideal golfing swing and end up without enough concentration on what could be considered to be the two most fundamental objectives in a golfing stroke: in the impact zone (a) moving club head 44 parallel to line 34, and (b) holding club head face 42 parallel to line 40.

The golfer is further confused by contradictory instructions on the ideal swing from various authorities. In truth, the other aspects of the swing are mostly to gain the objectives (a) and (b) above, and proficient golfers with different styles are still effective as long as standards (a) and (b) above are met. Of course there are other considerations, such as distance the ball is hit, but if one follows the maxim "first things first" my golfing aid gives visual indication of the two things most important to achieve. A basic look at the golfing stroke from the viewpoint of physics is that if ball 14 is hit by a club head 44 going in the right direction (lines 16, 22, 34) by a club head face 42 oriented properly (parallel to line 40), only more secondary things can prevent the desired flight, i.e., wind force and direction which can be allowed for by the proficient golfer and, in effect, involve estimated compensation in the direction of lines 16, 22, 34, putting surface in the case of putts which likewise involves estimated compensation in the direction of lines 16, 22, 34, etc. This is not to say that other things are not important but some can be derivative, i.e., an improper grip may result in failure to maintain proper club head orientation in the impact zone. It could even be offered that if the player concentrates on the elements of the swing concerned with my golfing aid 20, he may automatically develop some other aspects of an effective swing. In experiments with aid 20, the improvement in golfer's performance has been demonstrated.

Note that the visual golfing aid 20 is a practice instrumentality. It is not expected that the golfer will use it consistently in regular golfing but rather he will use it in practice until he has mastered what it has to teach, whereupon he will only use it for occasional brushup, when he develops a problem, etc.

Imagine the difficulty of a blind person trying to learn a sport. The golfer has a similar problem because the club head moves so fast through a swing that the golfer can not see what is going on. Consequently, the golfer must rely on the advice of a friend or a professional to tell him how he performed, or resort to deductive reasoning to reconstruct the swing. He feels frustrated and helpless as he can't depend upon himself to analyze his performance.

We learn most manual tasks by responding to and adjusting to visual feedback, i.e., trial and error, or hand-eye coordination. Without such feedback, a task becomes more difficult to master. The present golfing aid provides a visual model of what the golfer is trying to accomplish with the swing. By swinging in slow motion, he can recognize errors relative to these visual reference lines provided by aid 20 and can make needed adjustments. Once he learns to swing properly slowly, he can swing faster until a normal swing speed is achieved. In another sense, aid 20 provides a goal for the swing. With the goal properly defined and concentrated upon in practice, the golfer can learn and part of the learning may be subconscious, i.e., like proficient typing is partly subconscious.

Part of the learning process also involves visualization of the desired flight line, and aid 20 assists in learning to correctly visualize that line (which is difficult as the golfer normally is trying to visualize an imaginary line, from the side of the line, without any aid). Likewise, aid 20 gives a visual reference for adjustment of stance, so that the golfer does not have to rely entirely on his imagination for reference lines and points.

I have used the term "impact zone". The ends 48 of arms 30 are intended to define the ends of the impact zone. The words "impact zone" are not new with me. If an observer viewed an ideal swing from above (plan view), the trace of the club head would be straight in front of the golfer from a point somewhat behind the original ball location to a point somewhat ahead of the original ball location. All or part of the straight trace could be considered to be the impact zone. To each end of that straight or flat trace, the trace of the club head would curve. In the case of a right hand golfer, the rear curved trace would represent the movement of the club head in a direction that could be said to be generally pivotal relative to the right shoulder and the forward curved trace would represent the movement of the club head forward of the impact zone in a direction that could be said to be generally pivotal relative to the left shoulder. For the present purposes I define "impact zone" to be at least part of that "straight trace" and a distance in which it is practical, visually and physically, for a golfer to try to follow line 34.

A good length for the impact zone would be 10 inches, meaning that preferably each arm 30 would be 5 inches. I consider the minimum length should be around 7 inches, meaning that a shorter distance does not extend far enough to give the golfer sufficient guidance physically, mentally and optically. To explain the minimum dimension further, consider the hypothetical example of a 1 inch zone, in which case the golfer would have little sense of the extension of that 1 inch line, would not have a good sense of true direction (versus a direction some degrees deviating from the line), would have to depend on visual impression of extension of the 1 inch line for guidance of his club head approaching and passing the 1 inch line, etc. I consider the maximum length of the impact zone defined by arms 30 should be about 16 inches, and I prefer a shorter distance. Visually, I don't think a golfer can "take in" a line more than 16 inches, in concentrating on an outer portion of a longer line he might fail in the critical area near the ball, with two long a line he might have difficulty coordinating the curved portions of the club trace with the straight portions of the club trace, etc. The purpose of the impact zone is to direct the golfer as to maintaining a straight path of club head 44 parallel to line 34 during that part of the stroke and to maintain club head face 42 perpendicular to line 34 during that portion of the stroke.

There are other considerations in making golfing aid 20 besides those mentioned above. It is not enough for the device to be operative. The golfing aid also must be acceptable to the golfer in appearance, etc. For this reason, it is deemed important not only for the device to be attractive but also that it be collapsible. Although the device could be carried in expanded position, it is not only more convenient but also it is considered to be more acceptable, i.e., unobtrusive, etc., if it can be folded and put in a pocket or in the golf bag when it is not in use. I provide a collapsible construction by superimposing the inner ends of arms 30 to leg 32 and by pivotally mounting them by bolts 50 passing through openings in arms 30 and leg 32. Bolts 50 can be secured by lock nuts 52 so that once they are properly tightened (to permit pivoting of arms 30 but tending to hold expanded or collapsed position) no further adjustment is needed. Rounded, slotted head are attractive and avoid countersinking expense. A riveted construction would be another possibility.

A difficulty with a collapsible model is to properly orient arms 30 at 90° to leg 32 when the arms are expanded. Use of an abutment would be a possibility but would require either a molded part or another manufacturing operation, such as bonding an abutment in place. In either case, manufacturing tolerances would have to be carefully controlled or else arms 30 would deviate too much from the ideal 90° orientation. I have devised several different expedients to achieve the desired end. One is to provide that the inner ends of the arms abut at 54 in expanded position. Note that the arms would interfere if they were not cut off on lines 56. The inner ends of lines 56 terminate approximately on a line between the centers of bolts 50. If lines 56 terminated below the line between bolt centers 50 as viewed in FIG. 2, they would interfere in folding.

The abutment of inner ends of arms 30 at 54 does not by itself insure a 90° relationship of arms 30 to leg 32 unless manufacturing tolerances are tightly controlled. Two other guides to proper orientation of a structural nature are provided. One is for the user to orient arms 30 to coincide with the straight edge or line represented by end 60 of leg 32. The second guide is to align the outer end of each cut-off line 56 with the adjacent longitudinal edge of leg 32. This is a reliable guide because each arm 30 is half the width of leg 32 (note the nested full line collapsed position of arms 30 in FIG. 3) and because lines 56 extend at 22½° to the longitudinal axis or edges of arms 30. To further explain this, note in FIG. 2 the dashed lines 62 which represent squares each having a height and width equal to the width of arms 30 and having a bolt 50 at its center. If line 56 is at 22½° to the major axis of the associated arm 30, the inner end of line 56 lies on the line between the centers of bolts 50 and the outer end of line 56 coincides with the adjacent longitudinal edge of leg 32.

Figure 6:
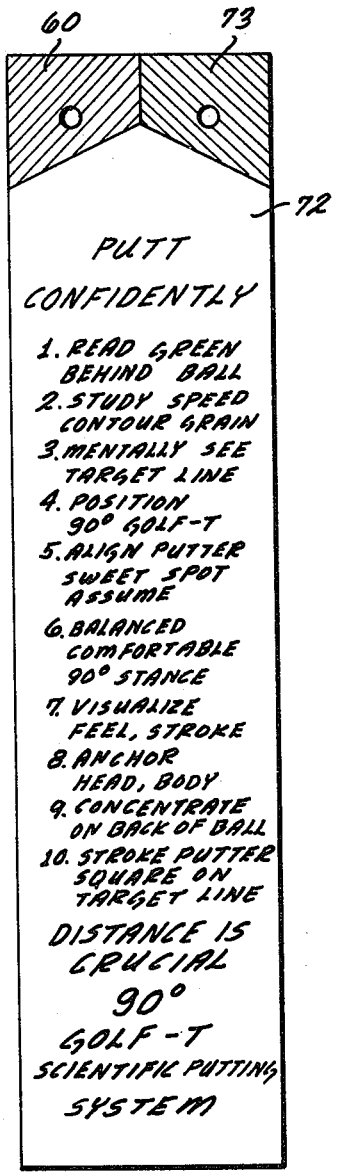
FIG. 6 is similar to FIG. 5 but shows modified indicia for putting.

The golfer will be looking at golfing aid 20 and its vicinity during practice and it is deemed important to display on the face of leg 32 some important reminders of basic considerations. Without such reminders, he may fail to use the aid to his satisfaction. In FIG. 5 the indicia 70 is adapted for strokes short of the green and FIG. 6 in the indicia 72 is adapted for putting. Note that end areas 73 for the normal position of the inner ends of arms 30 can be marked to aid in properly locating the arms at 90° to leg 32, by reproducing their outline in proper position. Separate aids preferably are provided for strokes short of the green and for putting but it would be possible to put indicia 72 on the back of the leg 32 of the same golfing aid 20. The various reminders or instrucions will be largely self-explanatory. Note that instruction 2 in FIG. 5 relates to line 16 and instruction 3 in FIG. 6 relates to line 22. Instruction 3 in FIG. 5 implicitly relates partly to aligning line 34 with line 16 and instruction 4 in FIG. 6 implicitly relates partly to aligning line 34 parallel to line 22. Instructions 5 in FIGS. 5 and 6 implicitly relate partly to aligning the club or putter face 42 parallel to line 40 (i.e., leg 32). Instruction 9 in FIG. 5 and instruction 10 in FIG. 6 implicitly relate partly to directing the club or putter head parallel to line 34 and to maintaining club or putter face parallel to leg 32. Although it is expected that golfing aid 20 will be sold together with an instruction book relating to use of golfing aid 20 and other matters, the use of indicia 70, 72 as instant reminders is believed to be important. An aid for putting could be smaller than one used for other strokes.

The method and means involved with my golfing aid 30 have been generally covered in the above discussion. In use, the golfer determines the desired flight line (usually line 16 short of the green and line 22 on the green). The aid 20 is positioned on the ground with the line 34 represented by the outer edge of arms 30 either coinciding with line 16 or parallel to line 22. Edge 34 may be positioned 3–4 inches from the ball (the distance being one of personal reference) with line 40 preferably bisecting the ball. The impact zone then is defined by the length of arms 30 to either side of the ball. Although I show arms 30 to be of equal length and with leg 32 halfway between the ends 48 of arms 30 (bisecting line 34), I do not discard the possibility that some source would prefer somewhat unequal length arms 30, i.e., for a right-handed golfer the left arm 30 7 inches and the right arm 30 5 inches, for additional guidance in the direction toward the objective. In any case, leg 32 should generally bisect line 34, whether or not it does so exactly. The golfer would next align club head or putter face 42 parallel to leg 32. Next, the golfer would building his stance, being sure his feet, hip and shoulders are equidistant from the flightline 16. He could adjust his stance forward (in the direction of desired flight) or rearward depending on his selection, i.e., the classical swing system versus the modern swing system. His objective, next, would be to learn by swinging first in slow motion (later by actual strokes) how to move the club head 44 through the impact zone, keeping the direction of club head movement parallel to line 34, while keeping club head face 42 parallel to leg 32. The golfer thus observes how adjustment in handgrip, stance, swaying, etc., affects the club head and face, thereby enabling him to improve his swing and correct his faults. When a ball is actually hit in a normal stroke, he can check his actual drive with lines 16, 22, 34. Similar training procedures can be used with all clubs and with the putter. The indicia 70, 72 displayed on leg 32 reminds him of important considerations during the training exercise.

How the objectives of my invention are met will be apparent from the foregoing. Various results are obtained. For example, increased proficiency means less time on the golf course and more people can play in a day. Enjoyment of the game is enhanced with more proficiency and less numbers of people will give up golfing. Having thus described my invention, I do not wish to be understood as limiting myself to the exact details of construction shown. Instead, I wish to cover those modifications thereof which will occur to those skilled in the art upon learning of my invention and which properly fall within the scope of my invention.

I claim:

1. A training device which defines for golfers an impact zone and the proper orientation of the club head and the club head face in the impact zone, said device consisting of:

(a) a body made from flat rigid materials and being of T-shape formed by two straight arms extending at right angles from opposite sides of a first end of a straight bar-shaped leg, the edges of said arms farthest from the second end of said leg being straight and aligned to define a first visible straight line to be positioned adjacent to a ball and between the golfer and the ball and to be substantially aligned with the desired direction of ball travel to indicate the direction the club head should go in the impact zone, the outer ends of said arms forming visible ends appropriately spaced to define an impact zone, said leg defining a second visible straight line to be positioned between the golfer and the ball, the second line generally bisecting said first line and being at right angles to said first line, said second line to extend toward the ball to thereby indicate the direction the club face should parallel in striking the ball, (b) means for pivotally connecting said arms at their inner ends to said leg so that they can be pivoted to a collapsed position aligned with said leg for carrying and storing, and means to secure said arms in collapsed and spread positions, said first end of said leg forming a straight line at 90° to said second line to assist in aligning said arms to form said first line at 90° to said second line, (c) said leg having double the width of each arm so that said arms can store side-by-side on said leg in their collapsed positions, said inner ends of said arms actually physically abutting when said arms are aligned in their spread positions to form said first line, the pivotal connection of each arm to said leg being located at the center of a square defined by the width of the arm and an equal distance from the inner end of the arm, each arm at its inner end being relieved on a line extending from a point thereon defined as a point substantially midway between the centers of pivotal connection of said arms to said leg to the adjacent outer edge of said leg when viewed with the arms aligned at 90° to said leg, whereby said arms will not interfere with each other in moving to collapsed position of said arms, and (d) indicia on the upper face of said leg instructing the golfer in usage including indicating substantially aligning said first line with the desired direction of ball travel and indicating moving said club head parallel to said first line in striking said ball while maintaining said club head face parallel to said second line.

* * * * *